US006354446B1

(12) United States Patent
Chang

(10) Patent No.: US 6,354,446 B1
(45) Date of Patent: Mar. 12, 2002

(54) SPACE-ADJUSTABLE INTERLOCKING BINDER-SUPPORTER/BOOKEND/ MAGAZINE-ORGANIZER

(76) Inventor: Gene H Chang, 4724 Wickford West, Sylvania, OH (US) 43560

( * ) Notice: Subject to any disclaimer, the term of this patent is extended or adjusted under 35 U.S.C. 154(b) by 0 days.

(21) Appl. No.: 09/691,417

(22) Filed: Oct. 18, 2000

Related U.S. Application Data

(60) Provisional application No. 60/164,249, filed on Nov. 8, 1999, and provisional application No. 60/173,057, filed on Dec. 24, 1999.

(51) Int. Cl.[7] ..... A47F 5/00

(52) U.S. Cl. ..... 211/43; 211/184; D19/34.1

(58) Field of Search ..... 211/43, 184; 108/61; D19/34.1

(56) References Cited

U.S. PATENT DOCUMENTS

| | | | | | |
|---|---|---|---|---|---|
| 305,863 | A | | 9/1884 | Thompson | |
| 1,682,060 | A | * | 8/1928 | Banks | |
| 1,725,702 | A | * | 8/1929 | Cubberley | |
| 2,545,844 | A | * | 3/1951 | Cougias | 211/43 |
| 3,601,258 | A | | 8/1971 | Stein | |
| D262,336 | S | * | 12/1981 | Barnstone | |
| 4,595,105 | A | | 6/1986 | Gold | |
| D286,302 | S | * | 10/1986 | Shuqar | D19/34.1 |
| 4,637,632 | A | * | 1/1987 | Rubash et al. | 211/43 X |
| 4,759,449 | A | | 7/1988 | Gold | |
| 4,874,099 | A | * | 10/1989 | Arnott et al. | 211/43 X |
| 5,074,420 | A | | 12/1991 | Cappel | |
| 5,183,163 | A | | 2/1993 | Slaiken | |
| 5,201,428 | A | * | 4/1993 | Pasinski et al. | 211/43 X |
| 5,205,420 | A | | 4/1993 | Petryzak | |
| 5,217,124 | A | | 6/1993 | Stone | |
| D341,621 | S | * | 11/1993 | Evenson | D19/34.1 |
| 5,732,832 | A | | 3/1998 | Kordowski | |
| 5,871,104 | A | | 2/1999 | Martinez | |
| 5,971,165 | A | | 10/1999 | Levins | |

* cited by examiner

*Primary Examiner*—Robert W Gibson, Jr.

(57) ABSTRACT

The present invention is a free-standing assembly of identical or similar modules with vertical panels that can support all kinds of reading and writing materials including books, binders, magazines, and files, in an upright manner. The multiple panels in an assembly can keep a set of the materials uprightly while users freely withdraw from or insert some copies into the set. The space between panels is adjustable to fit various thickness of the reading and writing materials between the panels. The total length of the assembly can be adjusted by changing the number of modules in the assembly. The modules are solidly interlocked with each other by snapping the notches on an arm and feet of one module to narrowing gaps at the openings of neighboring modules. The assembly requires no additional parts and tools. Thus it is easy to assemble and the manufacturing cost is low. Yet the structure of the assembly is rigid due to the interlocked arms and feet of the modules.

6 Claims, 7 Drawing Sheets

SPACE-ADJUSTABLE INTERLOCKING BINDER-SUPPORTER/BOOKEND/ MAGAZINE-ORGANIZER

This appln claims benefit of No. 60/164,249 Nov. 08, 1999 which claims benefit of No. 60/173,057 Dec. 24, 1999.

BACKGROUND—FIELD OF THE INVENTION AND PRIOR ART

The present invention relates to a device that can support reading or writing material including binders, books, magazines, notebooks, files in an upright manner on bookshelves or desktops. The device can support an arbitrarily mixed set of thick and thin, soft and hard cover copies. The device can be used multi-functionally as a binder supporter, a bookend, a document organizer, a magazine organizer, a file sorter, etc.

It is often desired to place a set of binders, books or magazines in an upright manner on a desktop or a bookshelf. Bookends are used as an economic and freestanding mean to support books and binders in an upright manner on a desktop or bookshelf. However, as one withdraws some copies out of a set of books or binders between bookends, the bookends may slip away thus causing the standing books or binders to fall. In addition, one also finds it is difficult to insert a thick book or a soft magazine into a tight set of books between bookends. It is even more problematic to hold several loose-leaf binders together by using bookends. This is because, if binders are not fully filled with sheets, the covers of the binders form angles. Thus the binders between bookends would bulge out as a user tries to push the bookends tightly. This is extremely inconvenient in libraries or offices where people have to frequently insert and withdraw binders, reference books, and magazines on shelves and desktops.

These problems are well recognized in prior arts. To avoid the bookends to slip away, one type of devices, represented by U.S. Pat. Nos. 5,183,163, 5,205,420 and 5,871,104, uses a special rack or some modifications on a bookshelf to support the bookends. The shortcoming is that bookends are not freestanding by themselves. A similar type of device, represented by U.S. Pat. Nos. 305,863 and 3,601,258, is clipped on a bookshelf board, thus cannot be placed on desktop and is not completely freestanding either. In addition, these inventions have not solved the following problem: as a user withdraw several thick books between the bookends, the remaining books would fall out.

U.S. Pat. No. 5,074,420 represents another type of solutions for the problems. It adds plural vertical dividers between the bookends so the remaining books can keep standing even if some books are taken out. However, the space between dividers are fixed. The fixed space for supporting thin magazines cannot fit thick dictionaries or binders and vice versa.

U.S. Pat. Nos. 4,759,449 and 5,732,832 represent the third type of solutions in which partitions (dividers) can be inserted in various slots of a prepared rack (consisting a base and back) so the space between the partitions can be adjusted. However, the structure of these devices is awkward and the partitions are not rigidly interlocked with the base and back. Because the total length of each unit is rather long, the multiple of the units are not likely to fit the existing dimension of a desktop or a bookshelf. Hence U.S. Pat. No. 4,759,449 has to cut its unit before the entire assembly can fit a bookshelf. U.S. Pat. No. 5,217,124 is also an adjustable divider device, which can be directly clamped on a bookshelf. Yet it cannot be put on a desktop and alike thus is not freestanding. Further, all these devices have the disadvantages of lack of sufficient structural rigidity, high manufacturing cost, inconvenience in assembling, etc.

The fourth solution is an add-on module that can be interlocked to the other. This type of devices are represented by U.S. Pat. Nos. 4,595,105 and 5,971,165. However, the space between the partitions is fixed thus the device is not flexible to support books of different thickness. Further each module consists several separate pieces. The structure of the assembly is neither sufficiently rigid nor sufficiently simple to assemble and manufacture.

SUMMARY

The present invention avoids all above problems. It does not need a rack. It is an assembly of identical or similar modules with vertical panels that can support a mix of books/binders/magazines/files in an upright manner. The space between panels is adjustable to fit various thickness of the reading and writing material between panels. The multiple panels of the assembly can keep the reading and writing material in an upright manner as users freely withdraw or insert copies between the panels. The total length of the assembly can be adjusted by changing the number of modules in the assembly, in order to fit the dimension of an existing bookshelf or desktop. The modules are solidly interlocked each other by snapping the notches of the arms and feet of one module to openings of its neighboring module. The assembly requires no additional parts or tools. The weight of the books on the assembly can automatically reinforce the structure of the assembly, and place the assembly solidly on a desktop or on a bookshelf. It is completely free standing.

DESCRIPTION OF THE PREFERRED EMBODIMENT

Figure 1:
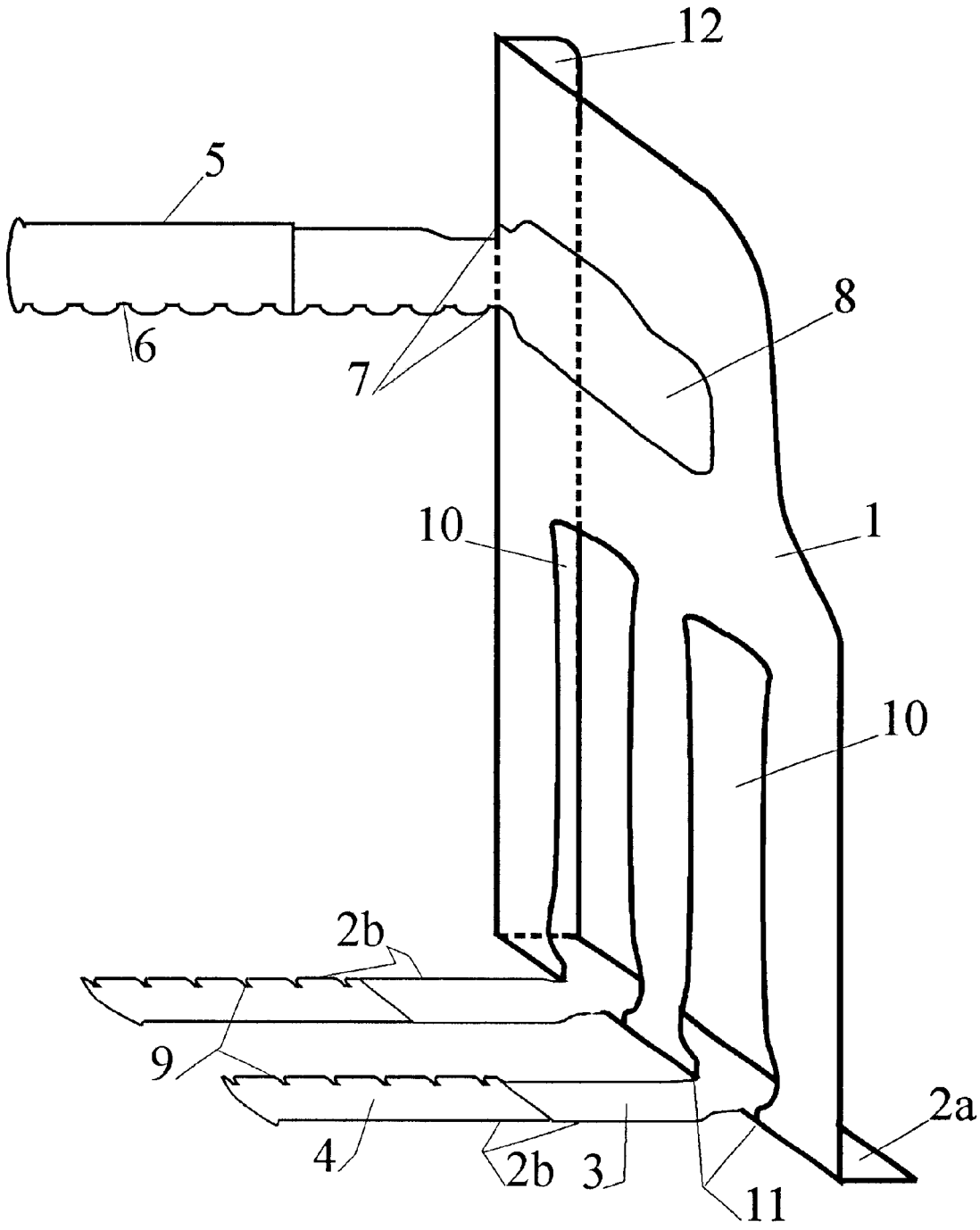
FIG. 1 is a three-dimensional illustration of a preferred embodiment of the invention. It is a module that can be added onto another module from the right.

The preferred embodiment is illustrated in the drawings.

FIG. 1 illustrates an organizer module consisting of a vertical panel 1 integrally formed with a folded base 2*a* and one or more feet 2*b*. Each foot 2*b* has two segments 3 and 4. Preferably, segment 4 is higher in elevation than segment 3 by about the thickness of segment 3. The module has at least one arm 5 extending substantially perpendicular to a rear portion of the vertical panel 1. Each vertical panel serves as a divider to support reading and writing material such as binders, books, magazines, etc. in an upright manner and to prevent them from falling out even if copies of them do not fully occupy the space between the panels of two modules.

Figure 2:
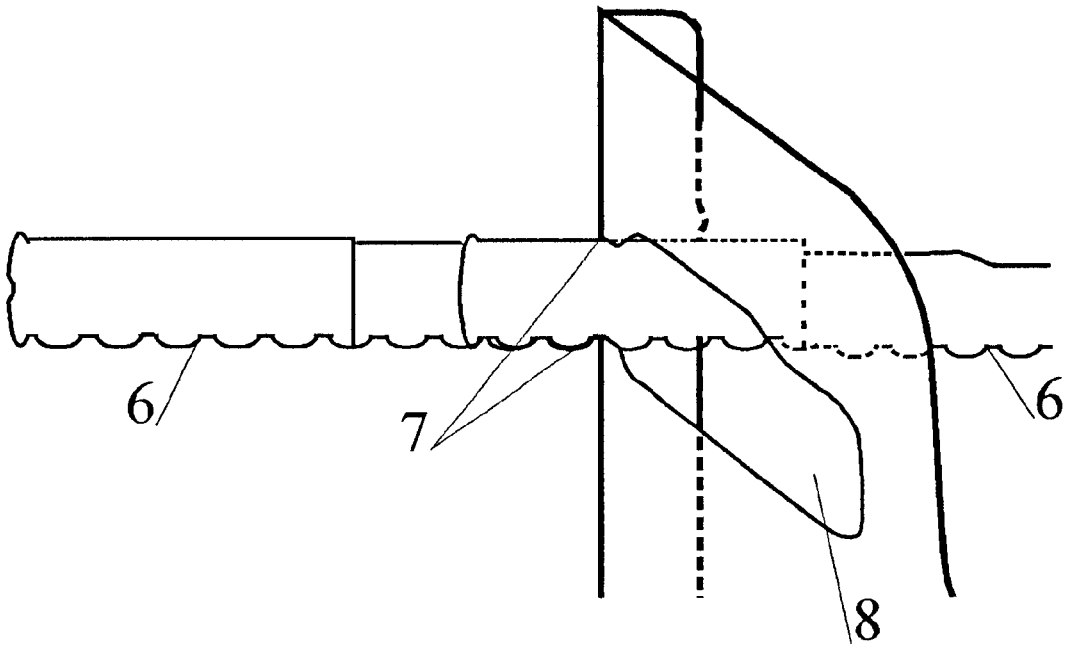
FIG. 2 is an exploded view to illustrate how two adjacent modules are interlocked by interlocking an arm of one module with an opening of its neighboring module.

The arm 5 is extended horizontally with a substantially long length. There are notches 6 on one or more edges of the arm. The vertical distance between each notch and its opposite edge of the arms is approximately equal to a width of a narrowing gap 7 at the back end of opening 8. Or, in a case of having notches on both edges, the vertical distance between a notch and a corresponding notch on the opposite edge is approximately equal to a width of a narrowing gap 7 at the back end of opening 8. The arm of a module can be inserted into the neighboring module's opening 8, and then notches 6 can be pressed fit or snapped into gap 7 of the neighboring module, to interlock the two modules together, as illustrated in FIG. 2.

Figure 3:
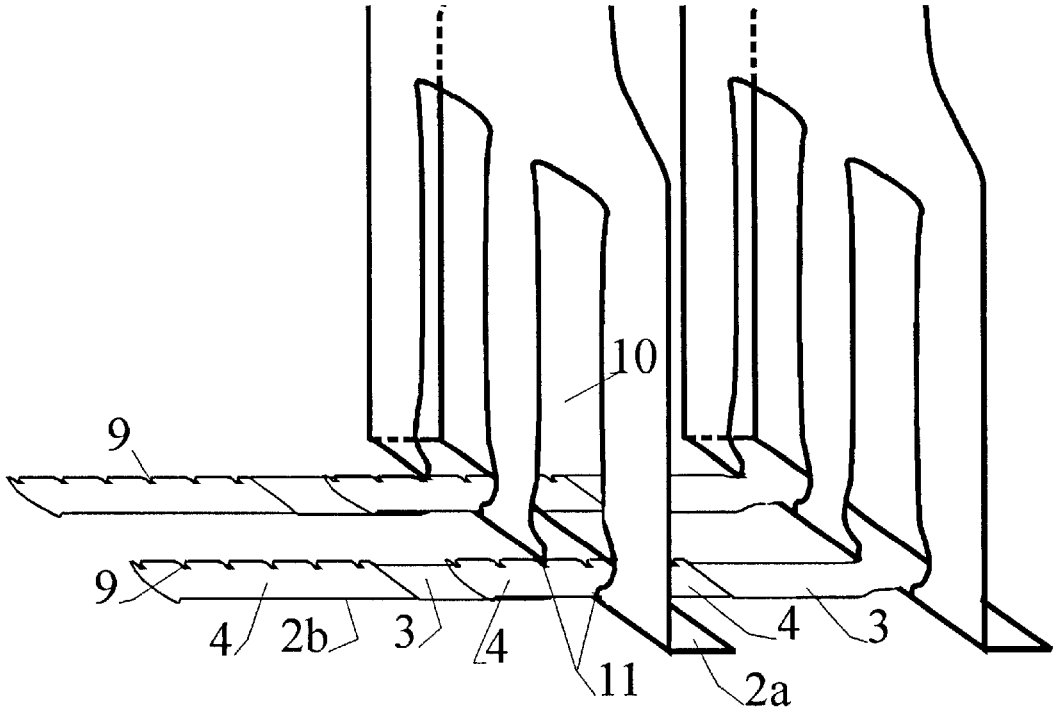
FIG. 3 is an exploded view to illustrate how two adjacent modules are interlocked through their feet.

In a similar way, the feet 2*b* of a module also have notches 9 on at least one edge of feet 2*b*. They are inserted into a neighboring module's openings 10 and pressed fit or snapped into narrowing gaps at bottom 11 of the openings 10. This is illustrated in FIG. 3. Segment 4 is higher in elevation than the height of segment 3 and base 2*a*, hence as segment 4 stacks on base 2*a* and feet segment 3 of the neighboring module, the two modules' bases and feet are still level.

By snapping different notches of the arm and feet into the gaps of the openings of the neighboring module, the space between the vertical panels 1 of two adjacent modules can be adjusted.

Figure 4:
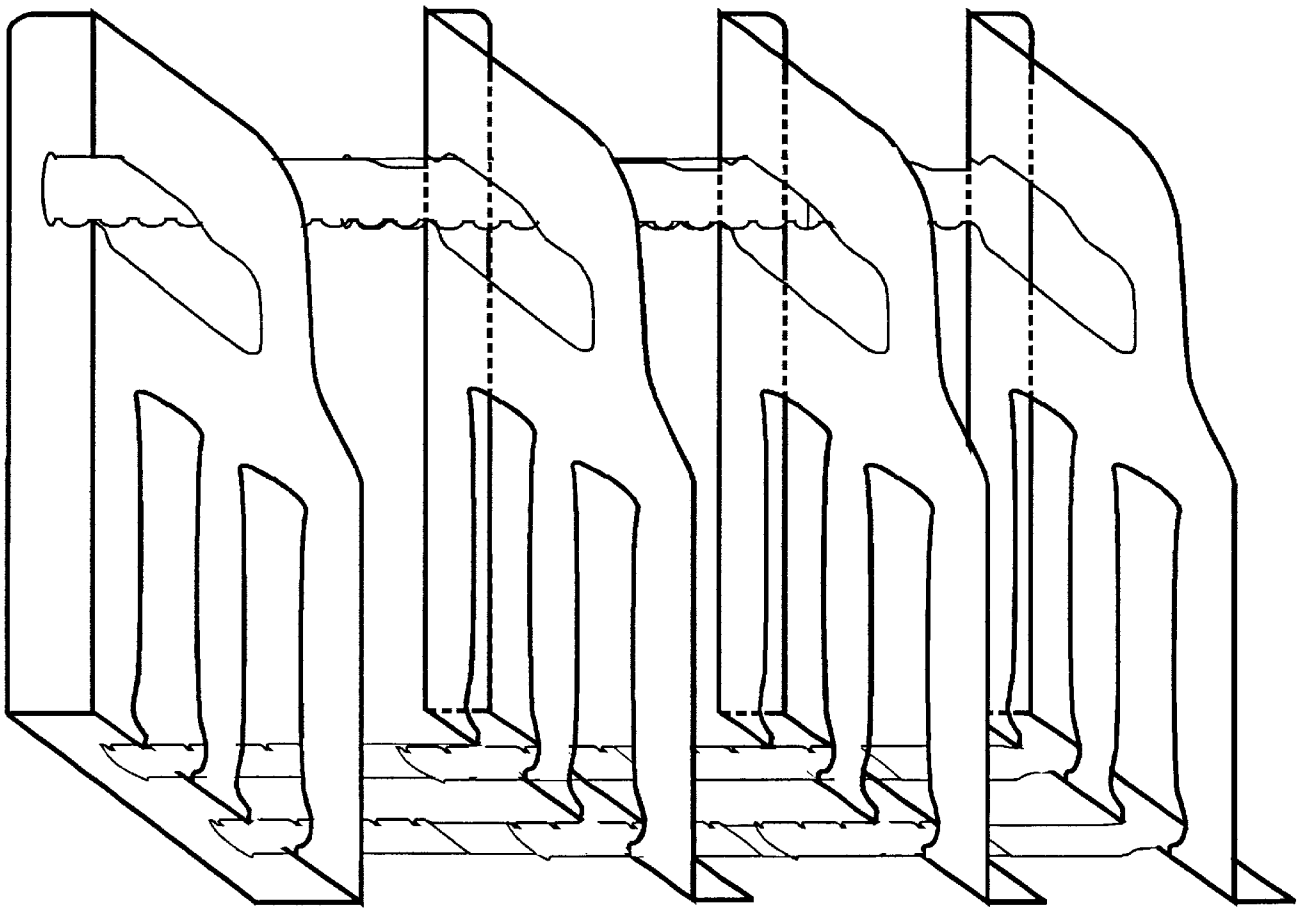
FIG. 4 illustrates how several add-on modules and a left-ending module are assembled into an assembly that can be a binder-supporter, a bookend, a magazine-organizer, or a file-sorter.
Figure 5:
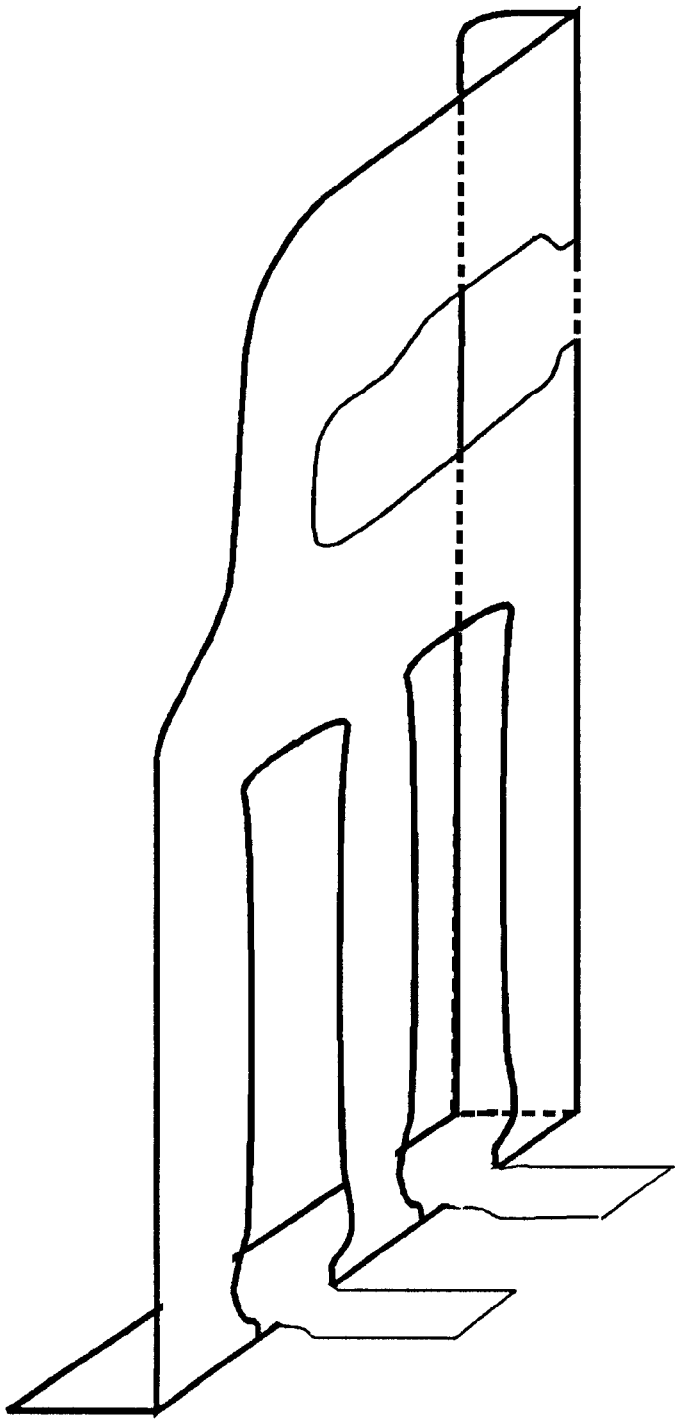
FIG. 5 is an illustration of a left-end module that can be attached onto the left end of an assembly.

The module shown in FIG. 1 is a regular add-on module that can be added on to the right of another identical add-on module. FIG. 4 shows how three add-on modules (the three ones to the right of the assembly as shown in FIG. 4) are assembled and interlocked each other. A left-end module of a complete assembly is somewhat different from an add-on module shown in FIG. 1. The left-end module is shown in FIG. 5. The left-end module looks somewhat like a mirror image of a regular add-on module, although it does not have an arm and its feet are shorter to allow to be overlapped by an add-on module's feet. The interlocking method for the left-end module is similar to the regular add-on modules, as illustrated in FIG. 4.

Figure 6:
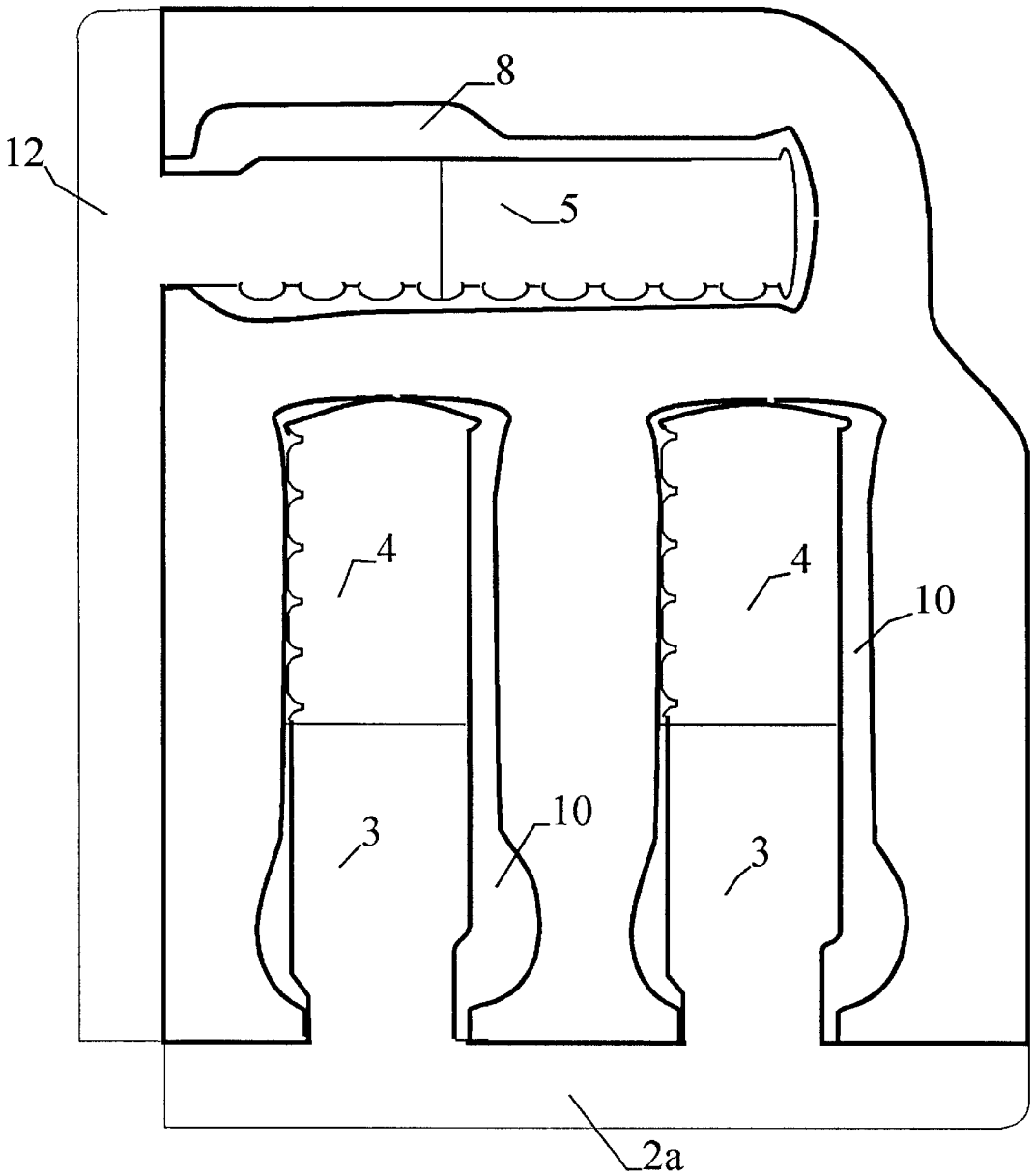
FIG. 6 illustrates how a module can be cut from one piece of metal.

The preferred embodiment as shown in the drawings requires no additional parts or tools such as racks, wires, screws, bolts, wrenches to assemble. It can be made from just one piece of metal. This is illustrated in FIG. 6. Arm 5 is cut from opening area 8, and feet 2*b* (consisting of segments 3 and 4) are cut from opening areas 10 of the metal sheet.

Folded part 12 helps not only the integration of arm 5 but also the structural rigidity of panel 1. Alternatively, the module can be made of plastic or other materials easily.

Figure 7:
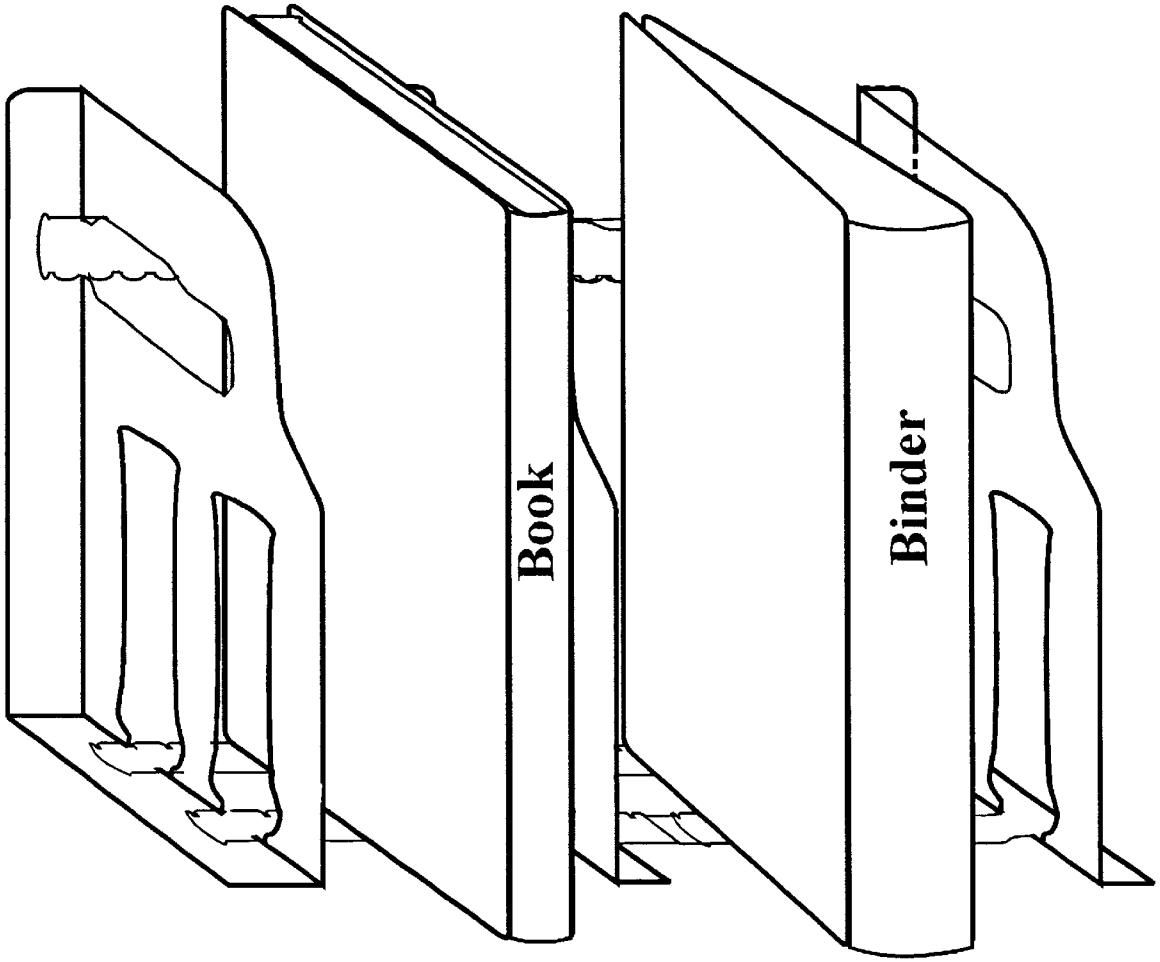
FIG. 7 illustrates how the books are supported between panels in the assembly.

FIG. 7 illustrates how books and binders are supported between panels in an assembly.

THE ADVANTAGES OF THE INVENTION

Some of the advantages of these inventions are summarized as follows:

1. The multiple upright panels of an assembly can support and keep the reading and writing material in an upright manner in the assembly as users freely withdraw copies out or insert copies into the assembly.
2. The space between modules thus the width between panels is adjustable to support either thin or thick documents in an arbitrary combination.
3. The total length of the modules can be adjusted by adding or removing modules to fit the dimension of an existing bookshelf or a desk.
4. By interlocking the modules at both arm and feet, the rigidity of the structure of the assembled modules and the whole assembly is strengthened. The weight of the books on the assembly automatically place the assembly solidly on a bookshelf or a desktop.
5. The structure is simple. No racks are needed. No fastening parts are needed.
6. It is easy to assemble. No tools are needed.
7. The device is easy to make thus the manufacturing cost is low. Each module can be stamped from just one piece of metal. Because of the rigidity of the structure and the interlocking support, the device can be made from a relatively thin metal sheet to reduce cost. Alternatively, if plastic is used to make the module, the cost to make a mold is also low because of the simple yet rigid structure.

It is to be understood, however, that even though numerous characteristics and advantages of the present invention have been set forth in the foregoing description, together with details of the structure and function of the present invention, the disclosure is illustrative only, and changes may be made in detail, especially in matters of material used, shape, size and arrangement of parts with the principles of the present invention to the full extent indicated by the broad general meaning of the terms in which the appended claims are expressed.

What is claimed is:

1. A device for supporting reading and writing materials in an upright manner, comprising:

a. a vertical panel, b. at least one foot formed substantially perpendicular to the vertical panel and is adjacent to a bottom portion of the vertical panel, c. at least one arm formed substantially perpendicular to the vertical panel and is adjacent to a rear edge portion of the vertical panel, and d. at least one opening on the vertical panel, whereby the device serves as a module that can be added onto another similar module by inserting the arm into an opening or openings of another similar module to interlock the two modules together.

2. A device according to claim 1, wherein the at least one arm of one module includes a plurality of notches capable of being inserted into an opening or openings of a neighboring module to interlock the two modules together and to selectively adjust the space between vertical panels of the two modules.

3. A device according to claim 1, wherein the at least one foot of one module can be inserted into an opening or openings of a neighboring module so as to help interlock the two modules together.

4. A device according to claim 1, wherein the at least one arm is formed from a piece of metal being partially cut from the an opening or openings of the vertical panel, and a portion of the at least one arm is integral with the vertical panel.

5. A modular device for supporting reading and writing materials in an upright manner, comprising:

a. a vertical panel, b. at least one foot formed substantially perpendicular to the vertical panel and is adjacent to a bottom portion of the vertical panel, and c. at least one arm formed substantially perpendicular to the vertical panel and is adjacent to a rear edge portion of the vertical panel, d. the arm consisting of a free end and a base whereby the base is adjacent to the vertical panel, the free end is opposite to the base, and e. the free end of the arm of a module can be interlocked to another identical module by interlocking means as the arms of two modules are oriented in a same direction, whereby the modular device serves as a module that can be added onto and be interlocked with another identical module, and whereby in a similar way an arbitrary number of identical modules can be interlocked together to form a system for supporting reading and writing materials.

6. A modular device according to claim 5 wherein the interlocking means to interlock two identical modules together, comprising:

a. notches on at least one edge of the arm and b. the notches can be pressed fit or snapped into a narrowing gap or gaps of an opening or openings of a neighboring module to interlock the two modules together.

wherein the space between the two modules is adjustable by snapping notches of one module selectively into the gap or gaps of an opening or openings of the neighboring module.

* * * * *